US010935901B1

(12) United States Patent
Qi et al.

(10) Patent No.: US 10,935,901 B1
(45) Date of Patent: Mar. 2, 2021

(54) METALLIC TONER PARTICLES

(71) Applicant: XEROX CORPORATION, Norwalk, CT (US)

(72) Inventors: Yu Qi, Penfield, NY (US); Shigeng Li, Penfield, NY (US); Richard P. N. Veregin, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/693,649

(22) Filed: Nov. 25, 2019

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 9/097*** | (2006.01) |
| ***G03G 15/08*** | (2006.01) |

(52) U.S. Cl.
CPC ..... *G03G 9/0902* (2013.01); *G03G 9/0819* (2013.01); *G03G 9/0825* (2013.01); *G03G 9/0827* (2013.01); *G03G 9/08755* (2013.01); *G03G 9/0926* (2013.01); *G03G 9/09708* (2013.01); *G03G 9/09725* (2013.01); *G03G 9/09783* (2013.01); *G03G 15/08* (2013.01)

(58) Field of Classification Search
CPC ..... G03G 9/0902; G03G 9/0926; G03G 9/0819; G03G 9/0825; G03G 9/0827
USPC ..... 430/110.3, 108.1
See application file for complete search history.

(56) References Cited

U.S. PATENT DOCUMENTS

| | | | | |
|---|---|---|---|---|
| 9,116,452 | B2 | 8/2015 | Koyatsu et al. | |
| 9,116,462 | B2 | 8/2015 | Ota | |
| 9,201,338 | B2 | 12/2015 | Kubo et al. | |
| 9,285,718 | B2 | 3/2016 | Hara et al. | |
| 9,367,000 | B2 | 6/2016 | Watanabe et al. | |
| 9,377,729 | B1 | 6/2016 | Nakamura et al. | |
| 2009/0111040 | A1* | 4/2009 | Veregin | G03G 9/09716 430/108.3 |
| 2009/0208256 | A1* | 8/2009 | Yamada | G03G 15/0818 399/286 |
| 2015/0248074 | A1* | 9/2015 | Suzuki | G03G 9/0821 430/105 |

* cited by examiner

*Primary Examiner* — Mark A Chapman
(74) *Attorney, Agent, or Firm* — Hoffman Warnick LLC

(57) ABSTRACT

Described herein is a metallic toner. The metallic toner includes flake shape toner particles having a binder resin, zinc stearate, silica having a particle size of from 7 nm to less than 12 nm in an amount of about 0.1 weight percent to 1.0 about weight percent of the flake shape toner particle and tabular shape metallic pigments. The flake shape toner particles have an average major axis length of from 6 μm to 20 μm, an average thickness of from 1 μm to 4 μm and an average circularity of from 0.5 to 0.97. The tabular shape metallic pigments have an average major axis length of from 1 μm to 14 μm an average thickness of from 0.01 μm to 0.5 μm.

18 Claims, 13 Drawing Sheets

METALLIC TONER PARTICLES

BACKGROUND

Field of Use

The present disclosure relates to toner particles and an image forming apparatus using the toner particles. More particularly, an additive package for metal toner particles is provided.

Background

In electrostatographic reproducing apparatuses, including digital, image on image, and contact electrostatic printing apparatuses, a light image of an original to be copied is typically recorded in a form of an electrostatic latent image upon a photosensitive member and the latent image is subsequently rendered visible by the application of electroscopic thermoplastic resin particles and pigment particles, or toner. The residual toner image can be either fixed directly upon the photosensitive member or transferred from the photosensitive member to another support, such as a sheet of plain paper for subsequent fixing or fusing.

In order to permanently fix or fuse the toner onto a support member by heat, it is necessary to elevate the temperature of the toner to a point at which the constituents of the toner coalesce and become tacky. This heating action causes the toner to flow to some extent into the fibers or pores of the support member. Thereafter, as the toner cools, solidification of the toner causes the toner to be bonded firmly to the support member.

Metallic toners have a higher conductivity than that of a regular toner. The higher conductivity of metallic toners can cause problems in the final print.

It would be desirable to have metallic toners that perform similarly to regular toners.

SUMMARY

Disclosed herein is a metallic toner. The metallic toner includes flake shape toner particles having a binder resin, zinc stearate, silica having a particle size of from 7 nm to less than 12 nm in an amount of about 0.1 weight percent to about 1.0 weight percent of the flake shape toner particle and tabular shape metallic pigments. The flake shape toner particles have an average major axis length of from 6 μm to 20 μm, an average thickness of from 1 μm to 4 μm and an average circularity of from 0.5 to 0.97. The metallic toner includes tabular shape metallic pigments have an average major axis length of from 1 μm to 14 μm an average thickness of from 0.01 μm to 0.5 μm.

Additionally, disclosed herein is an image forming apparatus that includes a photoreceptor having: a photosensitive layer; a charging device which charges the photoreceptor; an exposure device which exposes the charged photoreceptor to light, thereby forming an electrostatic latent image on a surface of the photoreceptor; and at least one developer station. The developer station develops the electrostatic latent image on a surface of the photoreceptor to form a toner image. The toner image includes flake shape toner particles having a binder resin, zinc stearate, silica having a particle size of from 7 nm to less than 12 nm in an amount of about 0.1 weight percent to about 1.0 weight percent of the flake shape toner particles and tabular shape metallic pigments. The flake shape toner particles have an average major axis length of from 6 μm to 20 μm, an average thickness of from 1 μm to 4 μm and an average circularity of from 0.5 to 0.9. The tabular shape metallic pigments have an average major axis length of from 1 μm to 14 μm an average thickness of from 0.01 μm to 0.5 μm. The imaging forming apparatus includes at least one transfer device for transferring the toner images to a recording medium. The image forming device includes a fuser station for fixing the toner image transferred to the recording medium by heating the recording medium, thereby forming a fused image on the recording medium, wherein the fuser station includes a fuser member and a pressure member.

Further, there is disclosed a metallic toner including flake shape toner particles having a binder resin, a surface additive, silica having a particle size of from 7 nm to less than 12 nm in an amount of about 0.1 weight percent to about 1.0 weight percent of the flake shape toner particles. The metallic toner includes silica having a particle size of from 12 nm to less than 30 nm in an amount of about 0.1 weight percent to about 1.0 weight percent of the flake shape toner particles. The metallic toner includes silica having a particle size of from 30 nm to 50 nm in an amount of about 1 weight percent to 3.0 weight percent of the flake shape toner particles. The flake shape toner particles have an average major axis length of from 6 μm to 20 μm, an average thickness of from 1 μm to 4 μm and an average circularity of from 0.5 to 0.97. The metallic toner includes tabular shape metallic pigments having an average major axis length of from 1 μm to 14 μm an average thickness of from 0.01 μm to 0.5 μm.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary and non-limiting.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Although embodiments of the disclosure herein are not limited in this regard, the terms "plurality" and "a plurality" as used herein may include, for example, "multiple" or "two or more." The terms "plurality" or "a plurality" may be used throughout the specification to describe two or more components, devices, elements, units, parameters, or the like. For example, "a plurality of resistors" may include two or more resistors.

Figure 1:
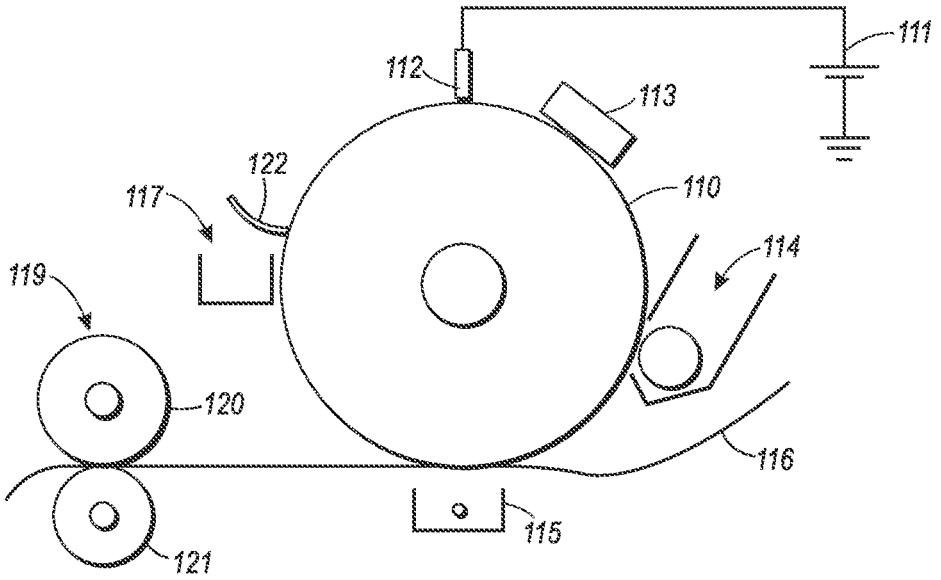
FIG. 1 is a schematic illustration of an image forming apparatus in accordance with the present disclosure.
Figure 2A:
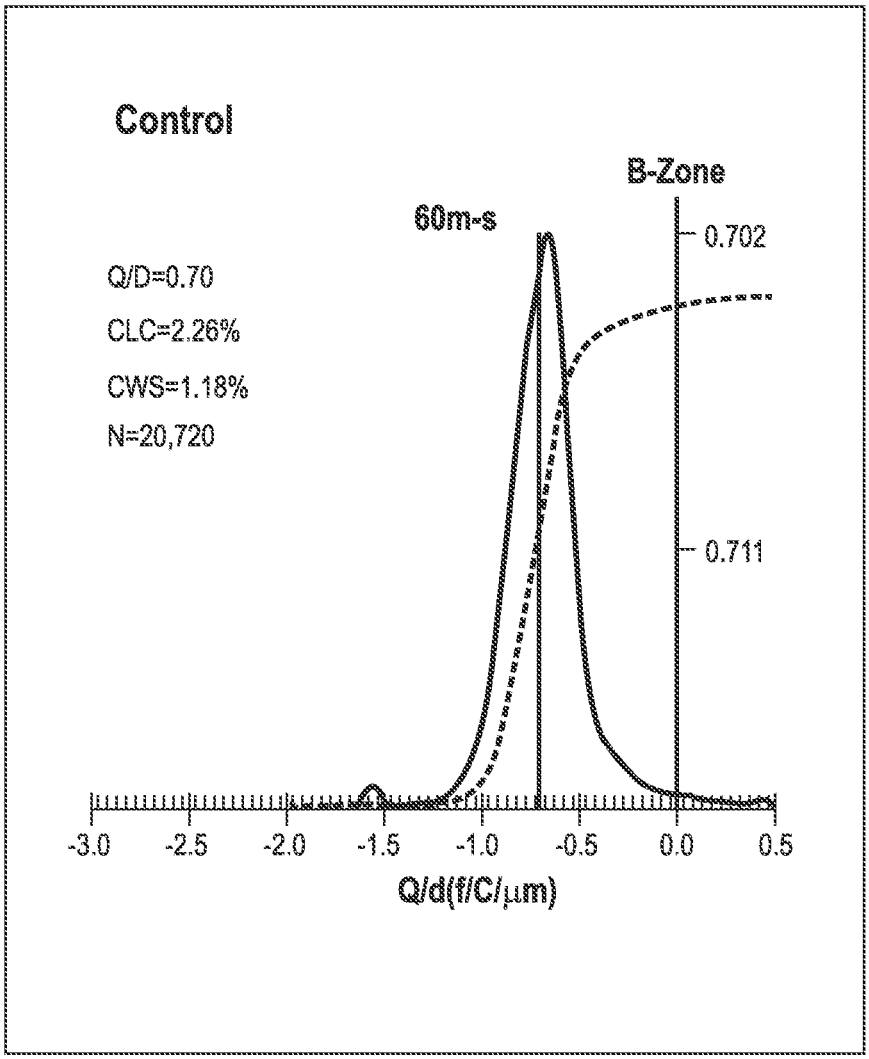
FIG. 2(*a*)-(*d*) show graphical representations of Q/D distribution of metallic toners in accordance with the present disclosure.
Figure 2B:
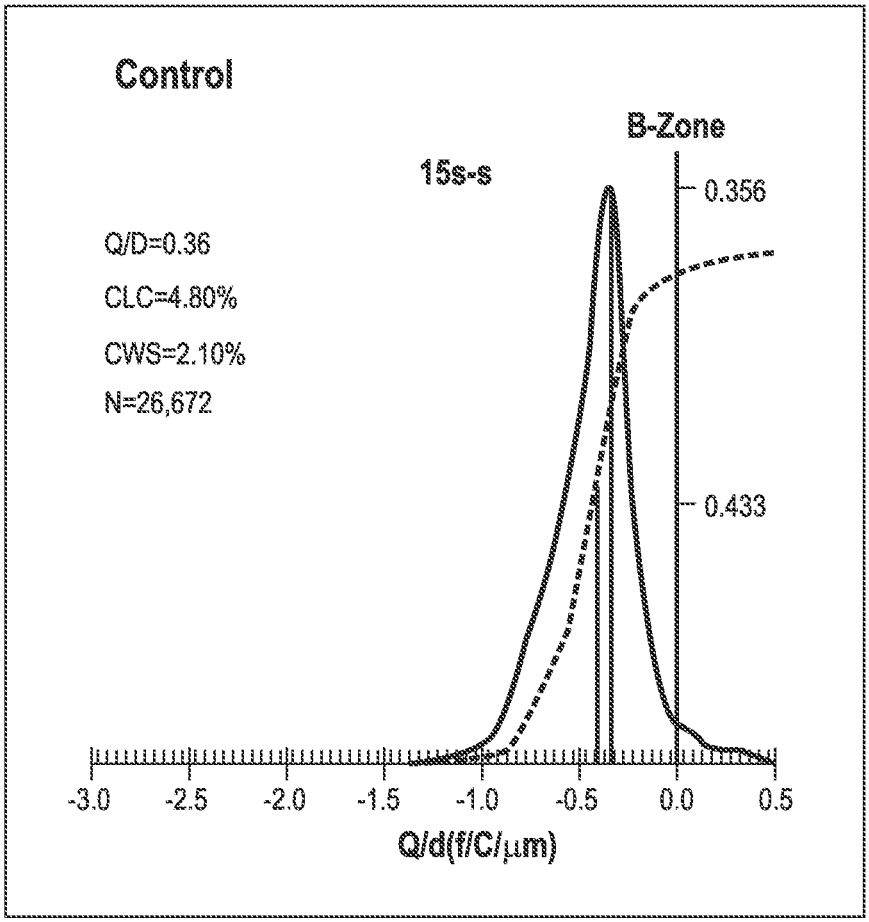
Figure 2C:
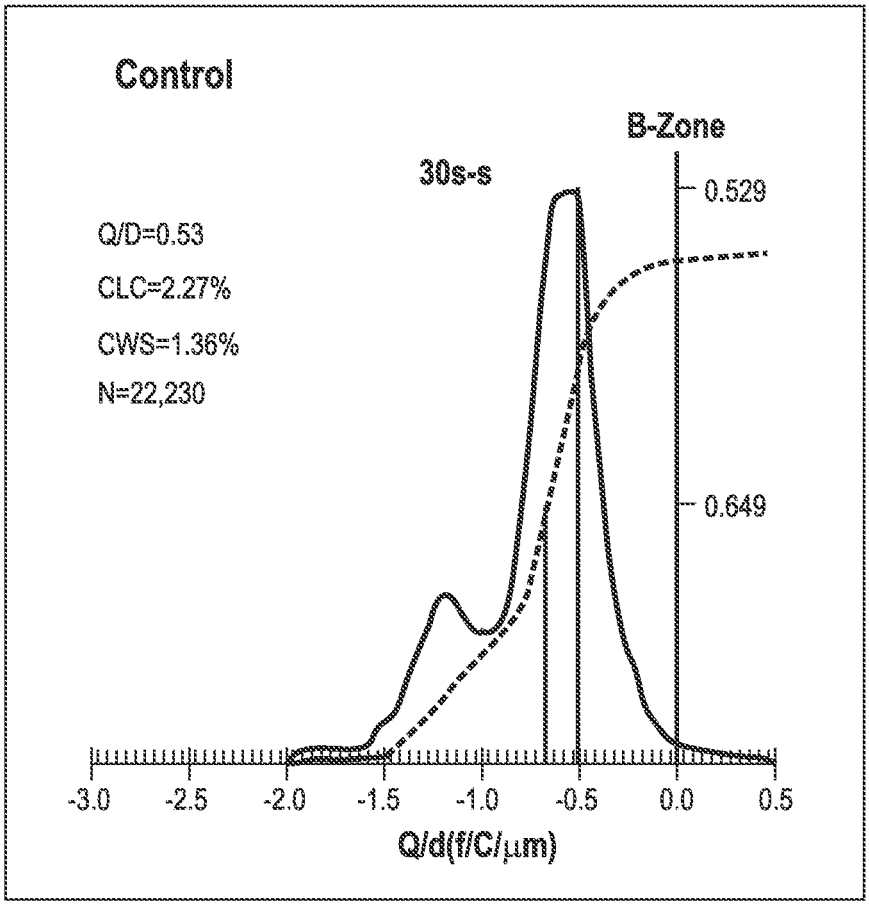
Figure 2D:
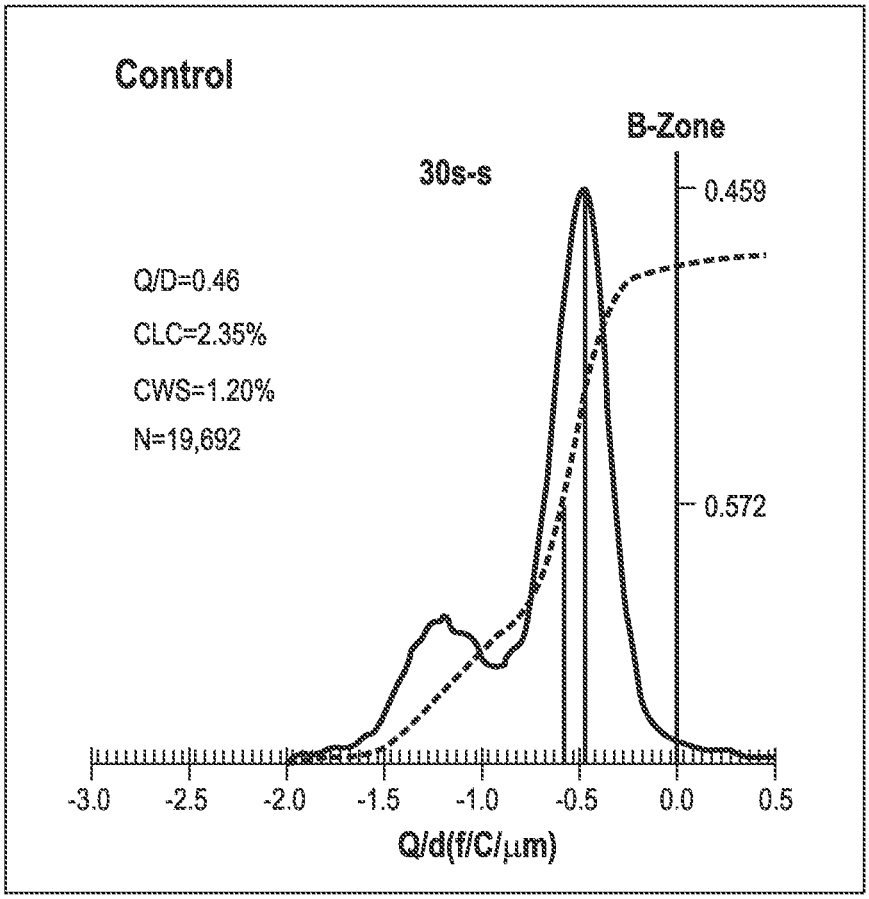
Figure 3A:
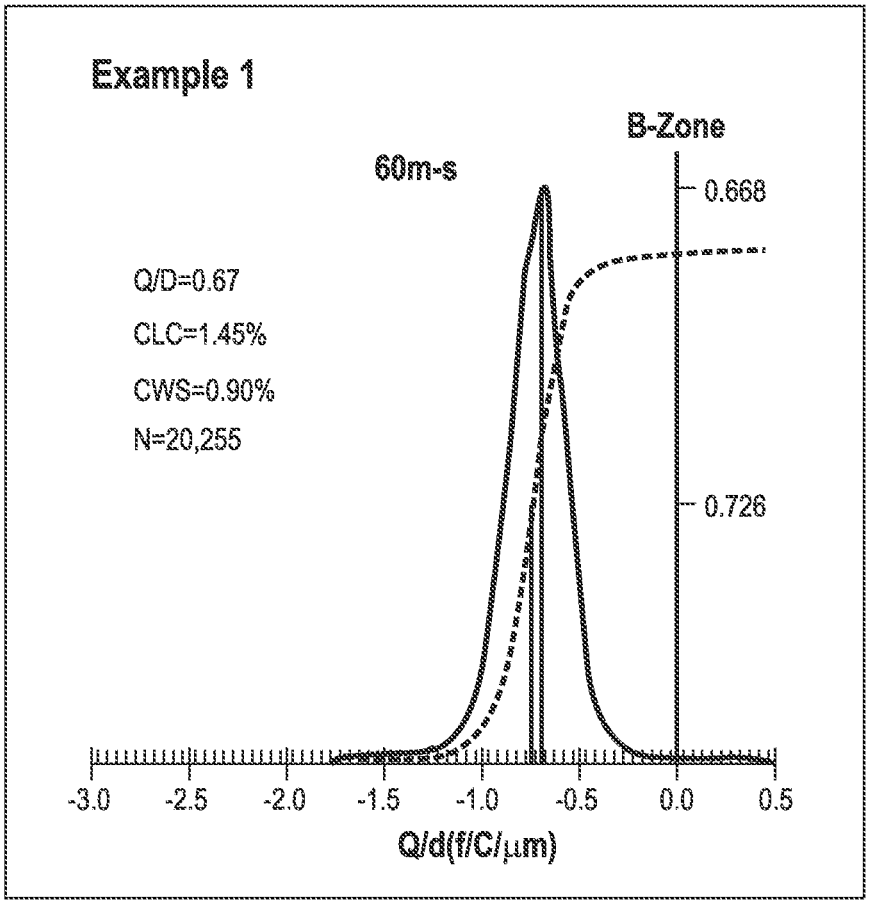
FIG. 3(*a*)-(*d*) show graphical representations of Q/D distribution of metallic toners in accordance with the present disclosure.
Figure 3B:
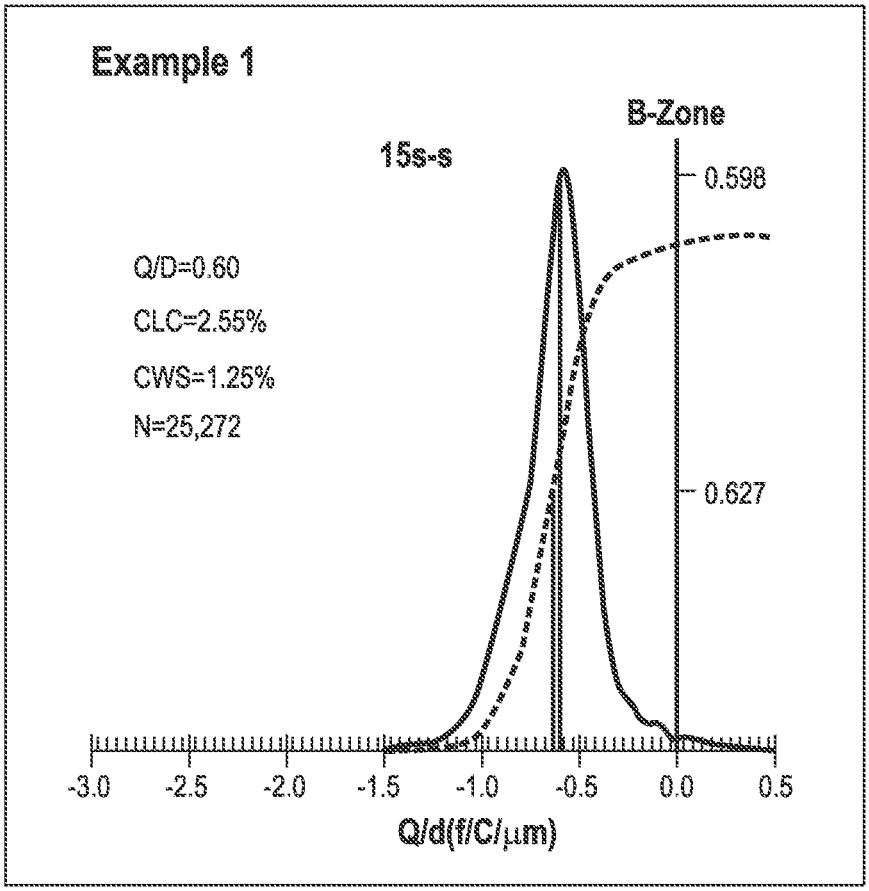
Figure 3C:
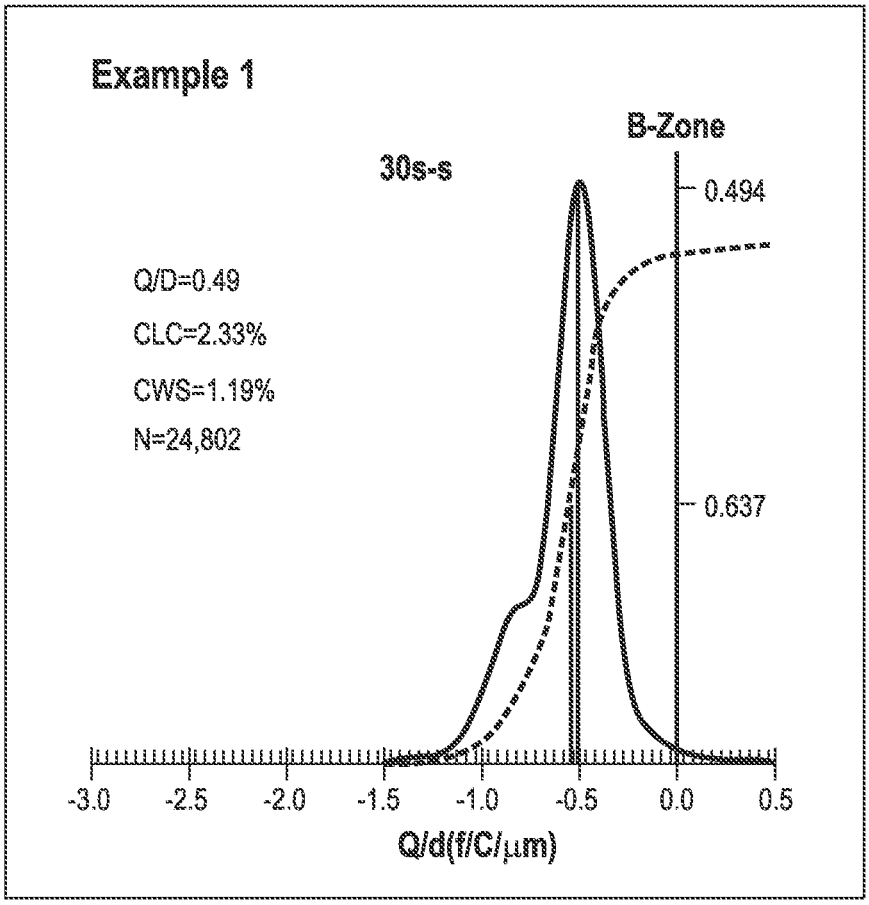
Figure 3D:
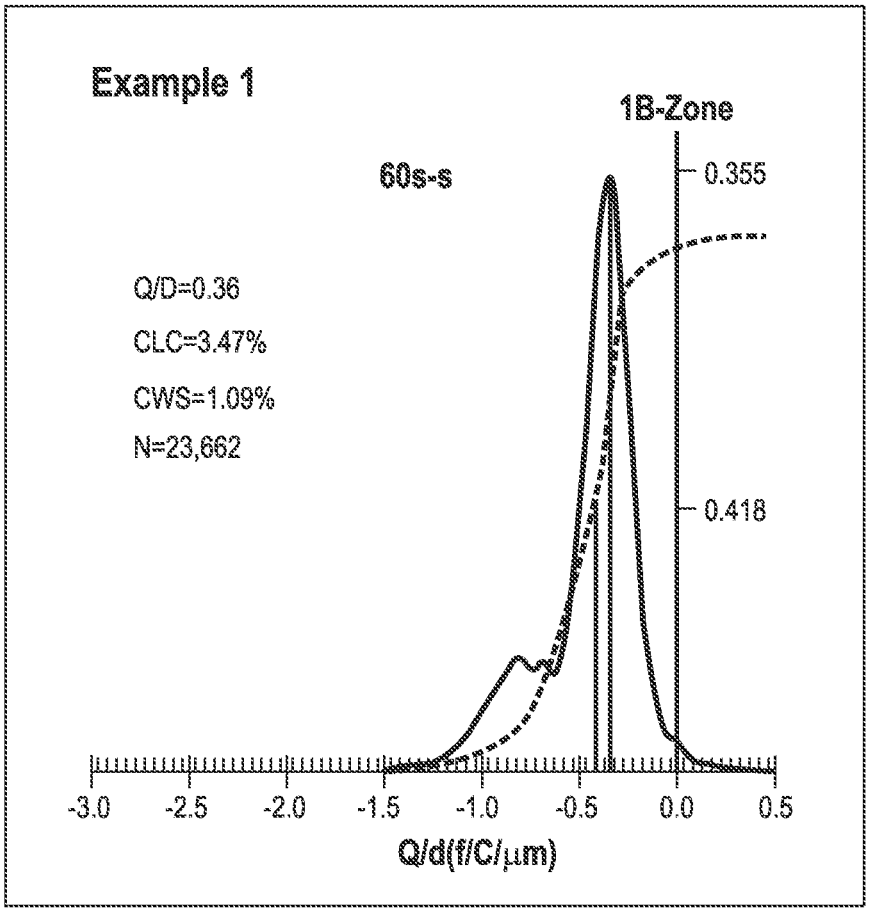
Figure 4A:
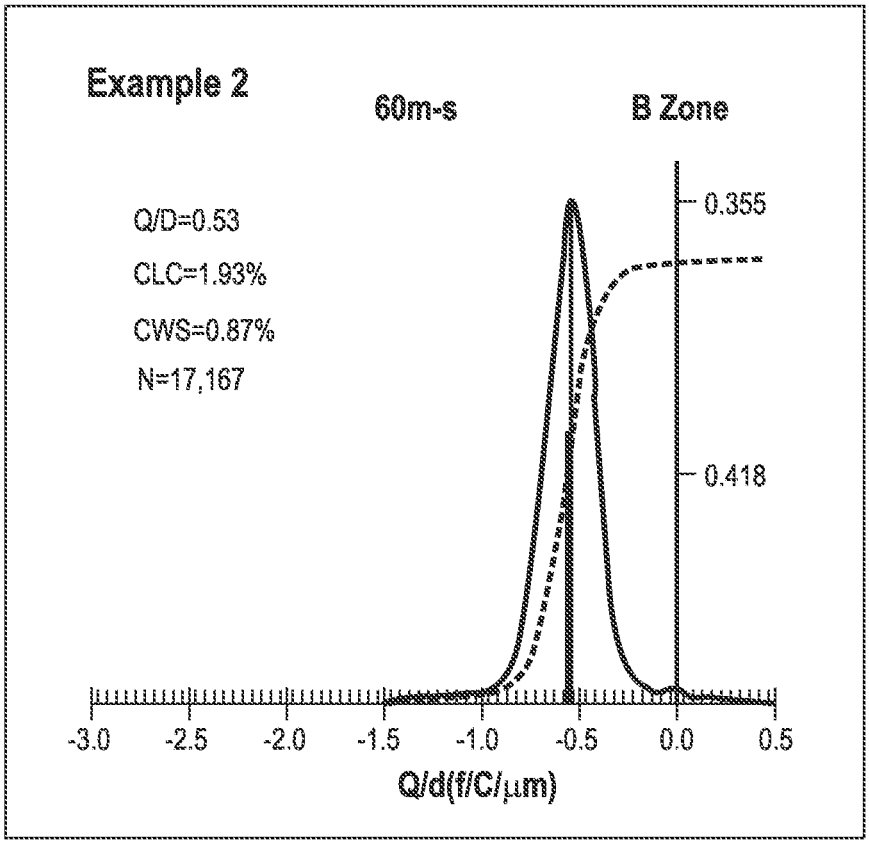
FIG. 4(*a*)-(*d*) show graphical representations of Q/D distribution of metallic toners in accordance with the present disclosure.
Figure 4B:
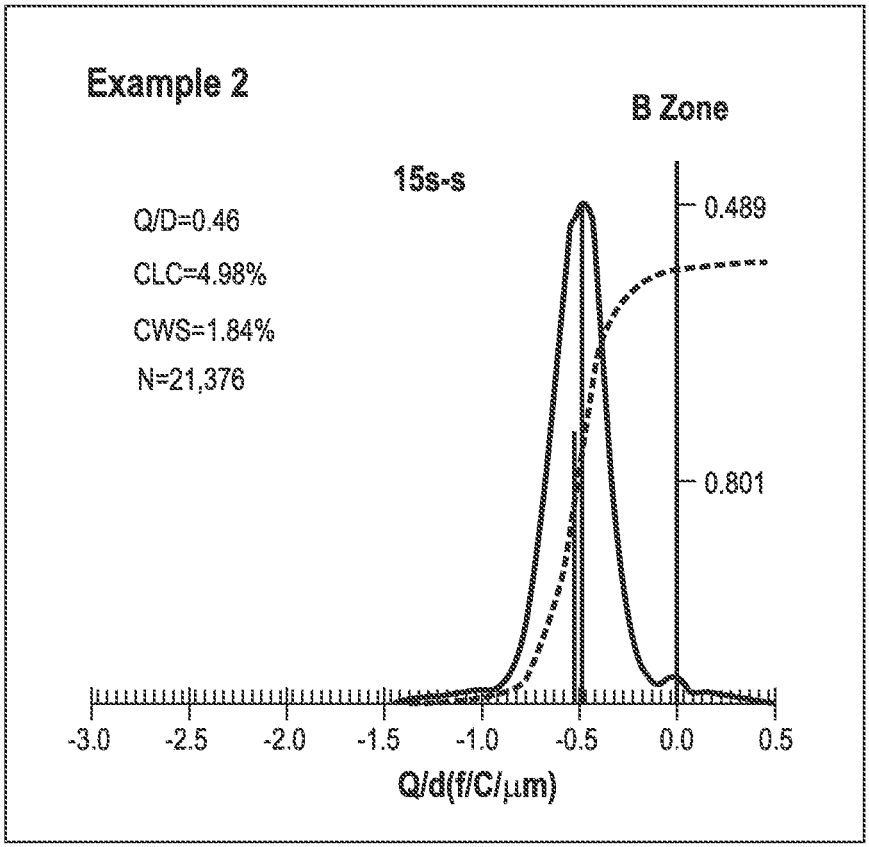
Figure 4C:
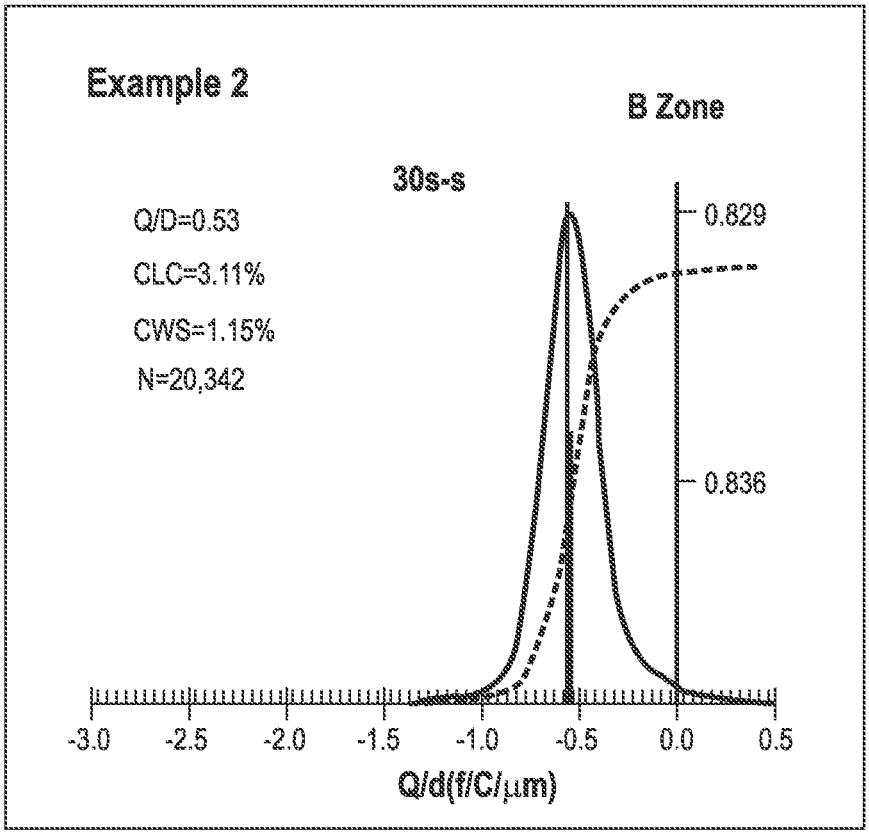
Figure 4D:
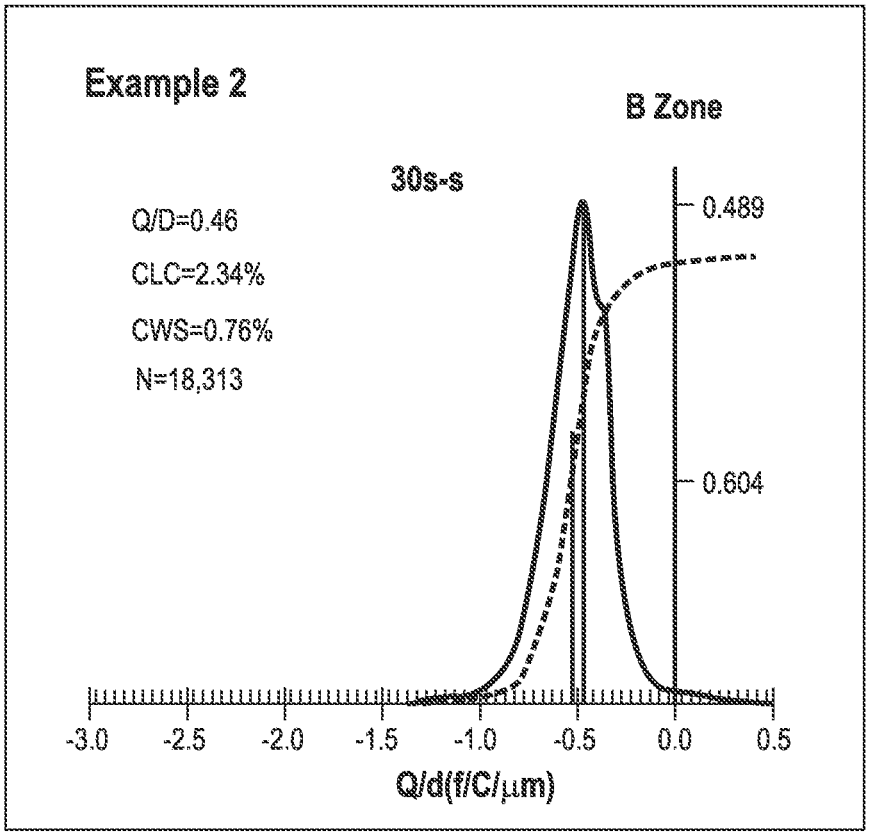

Referring to FIG. 1, in a typical electrostatic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 110 is charged on its surface by a charging device 112 to which a voltage is supplied from power supply 111. Photoreceptor 110 is then imagewise exposed to light from an optical system or an image input apparatus 113, such as a laser and light emitting diode, to form an electrostatic latent image on the photoreceptor 110. The photoreceptor 110 can be a drum or belt. In the embodiment of FIG. 1, the photoreceptor is shown as a drum. Generally, the electrostatic latent image is developed by bringing a developer mixture from developer station 114 into contact herewith. Development can be effected by use of a magnetic brush, powder cloud, or other known development process. A dry developer mixture usually includes carrier granules having toner particles adhering triboelectrically thereto. Toner particles are attracted from the carrier granules to the latent image, forming a toner powder image. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 116 by transfer apparatus 115, which can be performed by pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 116 advances to fusing station 119, depicted in FIG. 1 as fuser roll 120 and pressure roll 121 (although any other fusing member components such as fuser belt in contact with a pressure roll, fuser roll in contact with pressure belt, and the like, are suitable for use with the present apparatus), where the developed image is fused to copy sheet 116 by passing copy sheet 116 between the fusing and pressure members, thereby forming a permanent image. Alternatively, transfer and fusing can be effected by a transfix application. Photoreceptor 110, subsequent to transfer, advances to cleaning station 117, where any toner left on photoreceptor 110 is cleaned therefrom by use of a blade 122 (as shown in FIG. 1), brush, or other cleaning apparatus. Alternatively, transfer and fusing can be effected by a transfix application.

Metallic toners do not typically have a narrow charge distribution. Without a narrow charge distribution printing performance is compromised. Problems include high image background, toner spitting and toner dusting. Metallic toner particles with a flat shape having a high aspect ratio tend to interact strongly between particles and between the particle and the developer components in machine. This interaction causes the metallic toner particles to form agglomerates or to stick to a machine component, which results in poor image quality. It is hypothesized that the he small silica particle additive disclosed herein likely reduces the interaction force and enables the metallic particles to separate and less adhesive to the components. As a result, the image quality is improved.

The metallic toner described herein is applied by an image forming apparatus. The metallic toner includes a binder resin, a metal stearate, titanium dioxide and silica having a particle size of from 7 nm to less than 12 nm in an amount of about 0.1 weight percent to about 1.0 about weight percent of the metallic toner and tabular shape metallic pigments. In embodiments, the silica can have a particle size of from about 7 nm to about 10 nm, or from 8 nm to 10 nm. In embodiments, the amount of the silica is from 0.2 to about 0.8 weight percent of the metallic toner, or from about 0.3 to about 0.5 weight percent of the metallic toner. The metallic toner has a flake shape. The metallic toner flake shape particles have an average major axis length of from 6 μm to 20 μm, an average thickness of from 1 μm to 4 μm and an average circularity of from 0.5 to 0.97. In embodiments, the average major axis length is from about 6 μm to about 15 μm or from about 7 μm to about 10 μm. In embodiments, the average thickness of the metallic toner is from about 1.5 μm to about 3.5 μm or from about 2 μm to about 3 μm. In embodiments, the average circularity of the metallic toner is from about 0.5 to about 0.9 or from about 0.5 to about 0.8. The metallic toner includes tabular shape metallic pigments having an average major axis length of from 1 μm to 14 μm an average thickness of from 0.01 μm to 0.5 μm. In embodiments, the tabular shape metallic pigments have a major axis length is from about 2 μm to about 12 μm or from about 3 μm to about 10 μm. In embodiments, the tabular shape metallic pigments have an average thickness ifs from about 0.5 μm to about 0.4 μm or from about 0.1 μm to about 0.3 μm.

Silica

In some embodiments, the metallic toner may include silica having a primary particle size diameter of from 7 nm to less than 12 nm in an amount of about 0.1 weight percent to about 0.5 weight percent of the metallic toner and tabular shape metallic pigments. The small particle silica provides a narrow charge distribution to the metallic toner. In embodiments, the small silica is a negatively charging silica. Suitable negative charging silicas include 7 nm size Cabot silica TS-530 treated with HMDS; 7 nm Nippon Aerosil silica R976 treated with dimethydichlorosilane, 7 nm RX300, R812, and R812S, all three treated with hexamethyl disilazide (HMDS), and 7 nm R106 treated with octamethylcyclotetrasiloxane; and 8 nm Wacker H30TD treated with polydimethylsiloxane (PDMS), H30TM treated with HMDS, and H30TX treated with both HMDS and PDMS.

In embodiments a second silica may added in the size range of about 12 nm to less than 30 nm. Effective loadings of the second silica range from about 0.1 percent to 1 percent by weight of the metallic toner. Suitable second silicas include negative charging Nippon Aerosil 12 nm R974 treated with dimethyldichlorosilane, 12 nm RX200 treated with HMDS and 12 nm RY200 treated with PDMS, and 16 nm R202 and RY200S both treated with PDMS. In embodiments the second silica may include a positive charging silica, including Nippon Aerosil 12 nm R05 and RA200HS treated with HMDS and an aminosilane, and Wacker H2050 a 12 nm silica with a treatment that includes an alkyl amine and alklyamine salt, PDMS/$NR_2/N_R3^+$.

In embodiments, a third silica may be added in the size range of about 30 nm to about 50 nm. Effective loadings of the third silica range from about 1 percent to about 3 percent by weight of the metallic toner. Suitiable silicas include negatively charging Nippon Aerosil 40 nm RY50 and RX50, PDMS and HMDS treated respectively, 30 nm NY50 PDMS treated silica, 30 nm HMDS treated NAX50 silica, and positive charging 30 nm VP NA50H and Na50HS, both treated with a combination of HMDS and an aminosilane.

Titanium Dioxide

In some embodiments, a surface additive may include titanium dioxide. Titanium dioxide may be added as a toner surface additive in effective amounts of about 0.5 percent to about 2 percent by weight of the metallic toner, with a primary particles size of about 15 nm to about 40 nm. Suitable titanium dioxide particles include 40 nm STM5103 from Tayca which is treated with a decylsilane, 25 nm T805 titanium dioxide from Nippon Aerosil which is treated with octylsilane, and 30 to 50 nm STT-30 EHJ titanic from Titan Kogyo which is treated with silicone oil.

Metal Stearate

In some embodiments, a surface additive may include a metal stearate. The metal stearate may be included as a surface additive to improve charge level and to maintain sufficient developer conductivity in a conductive magnetic brush (CMB) development system, including Hybrid Jumping Development (HJD) systems and Hybrid Scavengless Development (HSD) systems, as described in U.S. Pat. Nos. 6,026,264 and 8,577,236 and references therein. Suitable metal stearates includes, but is not limited to, aluminum stearate, calcium stearate and zinc stearate. Effective of the stearate amounts vary from about 0.2 to about 1 weight percent of the metallic toner.

Metal Pigment

In some embodiments, a surface additive may include metal pigments. Examples of the metal pigment disclosed herein include a metal powder of silver, aluminum, brass, bronze, nickel, zinc, and the like. In addition, a coated metal pigment in which a surface of the metal pigment is coated with at least one metal oxide selected from the group consisting of silica, alumina, and titania may be used. When the pigment is Al, the Al content in the metal pigment is preferably from 40% by weight to 100% by weight and more preferably from 60% by weight to 98% by weight of the metallic pigment. The average major axis length of the metal pigment is from 1 μm to 14 μm and the average thickness from 0.01 μm to 0.5 μm, respectively.

The major axis length of the metal pigment refers to the longest portion of the tabular metal pigment when observed from the thickness direction of the metal pigment. When the average major axis length of the metal pigments is greater than 14 μm, it is difficult to prepare the metallic toner. The average major axis length of the specific metal pigments is preferably from 1 μm to 14 μm or in embodiments, from 5 μm to 12 μm. The average thickness of the tabular metal pigment is from 0.01 μm to 0.5 μm and in embodiments from 0.01 μm to 0.3 μm.

The content of the metal pigment in the metallic toner is preferably from 1 part by weight to 70 parts by weight of the binder resin and in embodiments from 5 parts by weight to 50 parts by weight with respect to 100 parts by weight of the binder resin described below.

Binder Resin

Examples of the binder resin may include vinyl-based resins including homopolymers of one monomer and/or copolymers of two or more monomers selected from the following monomers: styrenes (for example, styrene, parachlorostyrene, or .alpha.-methylstyrene); (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate); ethylenically unsaturated nitriles (for example, acrylonitrile or methacrylonitrile); vinyl ethers (for example, vinyl methyl ether or vinyl isobutyl ether); vinyl ketones (for example, vinyl methyl ketone, vinyl ethyl ketone, or vinyl isopropenyl ketone); and olefins (for example, ethylene, propylene or butadiene).

Other examples of the binder resin may include non-vinyl-based resins such as epoxy resins, polyester resins, polyurethane resins, polyamide resins, cellulose resins, polyether resins, or modified rosins; mixtures of the non-vinyl-based resins with the vinyl-based resins; and graft polymers obtained by polymerization of vinyl-based monomers in the coexistence of the above-described resins. These binder resins may be used alone or in a combination of two or more kinds.

Examples of polyester resins include a poly-condensate of a polyvalent carboxylic acid and a polyol. For an amorphous polyester resin, a commercially available resin may be used, or a synthesized resin may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, or sebacic acid); alicyclic dicarboxylic acids (for example, cyclohexane dicarboxylic acid); aromatic dicarboxylic acids (for example, terephthalic acid, isophthalic acid, phthalic acid, or naphthalene dicarboxylic acid); anhydrides of the above-described acids; and lower (for example, the number of carbon atoms is from 1 to 5) alkyl esters of the above-described acids.

Polyvalent carboxylic acid, a tri- or higher-valent carboxylic acid having a crosslinked structure or a branched structure may be used in combination of a dicarboxylic acid. Examples of the tri- or higher-valent carboxylic acid include trimellitic acid, pyromellitic acid, anhydrides thereof, and lower (for example, the number of carbon atoms is from 1 to 5) alkyl esters thereof. These polyvalent carboxylic acids may be used alone or in a combination of two or more kinds.

Examples of the polyol used in the binder resin include aliphatic diols (for example, ethylene glycol, diethylene glycol, triethylene glycol, propylene glycol, butane diol, hexane diol, or neopentyl glycol); alicyclic diols (for example, cyclohexane diol, cyclohexane dimethanol, or hydrogenated bisphenol A); and aromatic diols (for example, ethylene oxide adducts of bisphenol A or propylene oxide adducts of bisphenol A). Among these, as the polyol, for example, aromatic diols and alicyclic diols are preferable, and aromatic diols are more preferable.

As the polyol, a tri- or higher-hydric alcohol having a crosslinked structure or a branched structure may be used in combination of a diol, Examples of the tri- or higher-hydric alcohol include glycerin, trimethylolpropane, and pentaerythritol. These polyols may be used alone or in a combination of two or more kinds.

In some embodiments, a glass transition temperature (Tg) of the polyester resin is from 50° C. to 80° C. and in embodiments from 50° C. to 65° C.

In some embodiments, a weight average molecular weight (Mw) of the polyester resin is from 5,000 to 1,000,000 and in embodiments from 7,000 to 500,000.

In some embodiments, a number average molecular weight (Mn) of the polyester resin is from 2,000 to 100,000.

In some embodiments, a molecular weight distribution Mw/Mn of the polyester resin is from 1.5 to 100 or in embodiments from 2 to 60.

The weight average molecular weight and the number average molecular weight are measured by gel permeation chromatography (GPC). The weight average molecular weight and the number average molecular weight are calculated using a molecular weight calibration curve that is prepared from a monodisperse polystyrene standard sample based on the measurement result.

The polyester resin may be prepared using, for example, a well-known preparation method. Specifically, in this method, for example, a polymerization temperature is set to be from. 180° C. to 230° C., the internal pressure of the reaction system is optionally decreased, and a reaction is caused while removing water and alcohol produced during condensation.

When monomers of raw materials are not soluble or compatible at a reaction temperature, a high boiling point solvent may be added thereto as a solubilizer to dissolve the monomers therein. In this case, the poly-condensation reaction is carried out while distilling the solubilizer away. When a monomer having poor compatibility is present in the copolymerization reaction, the monomer having the poor compatibility may be condensed with an acid or an alcohol which is to be poly condensed with the monomer, and then the obtained condensate may be poly-condensed with a major component.

In some embodiments, the content of the binder resin in the metallic toner is, for example, from 40% by weight to 95% by weight, or in embodiments from 50% by weight to 90% by weight, or from 60% by weight to 85% by weight with respect to the total weight of the toner particles.

The metallic toner optionally may further include a release agent and other additives.

Release Agent

Examples of the release agent include hydrocarbon waxes; natural waxes such as carnauba wax, rice wax, or candelilla wax; synthetic or mineral and petroleum waxes such as montan wax; and ester waxes such as fatty acid esters or montanic acid esters. The release agent is not limited to these examples.

In some embodiments, the content of the release agent is, for example, from 1% by weight to 20% by weight and in embodiments from 5% by weight to 15% by weight with respect to the total weight of the metallic toner.

Other Additives

Examples of other additives may include well-known additives such as a magnetic material, a charge control agent, or an inorganic powder. The metallic toner particles contain these additives as internal additives.

The metallic toner may be produced by preparing toner particles and adding external additives to the toner particles.

A method of preparing the metallic toner is not particularly limited, and may be prepared using a well-known dry method such as a kneading and pulverizing method or a well-known wet method such as an emulsion aggregating method or a dissolution suspension method.

Various aspects of the embodiments of interest now will be exemplified in the following non-limiting examples. While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature(s) may be combined with one or more other features of the other implementations as may be desired and advantageous for any given or particular function.

EXAMPLES

Various metallic toners were prepared as follows.

A dispersion of aluminum flake pigment (45 g) with an anionic surfactant in deionized water was stirred overnight at room temperature. To the dispersion was added aluminum sulfate solution and a polyester emulsion mixture portion by portion while the reaction temperature was increase from 40° C. to 48° C. The polyesters include two types of amorphous polyesters and a crystalline polyester. After the aggregation was completed, the particle dispersion was frozen with a chelation agent at pH about 8. The mixture was then heated up to 84° C. to coalesce. When the circularity reached 0.940, the batch was quenched at below 40° C. The resulting silver toner particles were washed with deionized water and freeze-dried to powder.

A mixture of 50 g of silver toner particles made by the method described above was combined with 1.75 g of silica having a size range of from 30 nm to 50 nm (Na50HS) (Silica 1), 0.8 g of titania (SMT5103), 0.25 g of zinc stearate (ZnSTL), 0.1 g of silica having a size of from 12 nm to 30 nm (H2050) (Silica 2) and various amounts of silica having a a size of from 7 nm to 10 nm (TS-530) (Silica 3) was blended with a Fuji mill blender at 125 rpm for 1 min. The resulting blended toner was subjected to charge spec evaluation. The additive formulation is summarized in Table 1 below.

TABLE 1

| Silver particle ID | Silica 1 (wt %) | titania (wt %) | Zinc stearate (wt %) | Silica 2 (wt %) | Silica 3 (wt %) |
|---|---|---|---|---|---|
| Control | 3.3 | 1.5 | 0.4 | 0.2 | 0 |
| Example 1 | 3.3 | 1.5 | 0.4 | 0.2 | 0.2 |
| Example 2 | 3.3 | 1.5 | 0.4 | 0.2 | 0.4 |

Metallic toner admix mixtures were measured by preparing a developer in B-zone with 100 grams of Xerox iGen3 carrier and 4 grams of metallic toner in a 4 ounce bottle as shown in Table 1. The developer was conditioned in B-zone at 70° F. and 50% RH overnight, then the bottle was flipped three times by hand, then mixed on a paint shaker in three 15 minute segments, with 10 minutes cool down between each segment. After a total of 60 minutes of mixing on the paint shaker a sample is taken for measurement. Then a further 2 grams of metallic toner, which also had been conditioned in B-zone overnight, was added to the charged developer. Again the developer is flipped 3 times by hand, and the developer is mixed again on the paint shaker, taking samples after 15 seconds, 30 seconds and 60 seconds for measurement. All samples, the initial sample at 45 minutes of charging and the three samples at 15, 30 and 60 seconds are analyzed using a charge spectrograph and image analysis to determine the Q/D charge to diameter ratio distribution. To ensure good printing performance with low image background, minimal toner spitting and minimal toner dusting, the charge distribution is required to be a narrow single peak, with little or no indication of a second peak in the charge distribution. The total width of the Q/D peak should be no more than about 1 femtocoulomb/micron (fC/μm).

Admix mix results in FIGS. 2(*a*)-2(D) that the Control without the TS-530 showed a broadened distribution at all admix times of 15, 30 and 60 s, showing a total width of 1.5 fC/μm or more, and also a second peak in the Q/D distribution. Only the initial 60 minute charge distribution was narrow. FIGS. 3(*a*)-3(*d*), for metallic toner (Example 1) with 0.2 weight percent of silica having a particle size of from 7 nm to 10 nm, shows much improved distributions through the 15, 30 and 60 seconds admix, with a total peak width approaching about 1 fC/μm, though with a slight amount of a second peak at 30 seconds and more evident at 60 s. FIGS. 4(*a*)-4(*d*), for metallic toner (Example 2) with 0.4 weight percent of silica having a particle size of from 7 nm to 10 nm, shows narrow distributions throughout, all no more than about 1 fC/μm in total width, with no evidence of a second peak in the distribution.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A metallic toner comprising:

flake shape toner particles having a binder resin, a surface additive, silica having a particle size of from 7 nm to less than 12 nm in an amount of about 0.1 weight percent to about 1.0 weight percent of the flake shape toner particles and tabular shape metallic pigments, silica having a particle size of from 12 nm to 30 nm in an amount of about 1 weight percent to 3.0 weight percent of the flake shape toner particles, silica having a particle size of from 30 nm to 50 nm in an amount of about 1 weight percent to 3.0 weight percent of the flake shape toner particles, the flake shape toner particles having an average major axis length of from 6 μm to 20 μm, an average thickness of from 1 μm to 4 μm and an average circularity of from 0.5 to 0.97, and the tabular shape metallic pigments having an average major axis length of from 1 μm to 14 μm an average thickness of from 0.01 μm to 0.5 μm.

2. The metallic toner according to claim 1, wherein the tabular shape metallic pigments are selected from the group consisting of: silver, aluminum, brass, bronze, nickel and zinc.

3. The metallic toner according to claim 1, wherein the surface additive comprises a metal stearate is in an amount of 0.2 weight percent to about 1.0 weight percent of the flake shape toner particles.

4. The metallic toner according to claim 3, where the metal stearate is selected from the group consisting of: aluminum stearate, calcium stearate and zinc stearate.

5. The metallic toner according to claim 1, further comprising a wax.

6. The metallic toner according to claim 1, further comprising titanium dioxide in an amount of 0.5 weight percent to 2 weight percent of the flake shape toner particles.

7. The metallic toner according to claim 6, wherein the titanium dioxide has a particle size of from 15 nm to 40 nm.

8. The metallic toner according to claim 1, further comprising a charge control agent.

9. An image forming apparatus comprising:

a photoreceptor having: a photosensitive layer; a charging device which charges the photoreceptor; an exposure device which exposes the charged photoreceptor to light, thereby forming an electrostatic latent image on a surface of the photoreceptor; and at least one developer station, the developer station develops the electrostatic latent image on a surface of the photoreceptor to form a toner image comprising flake shape toner particles having a binder resin, a surface additive, silica having a particle size of from 7 nm to less than 12 nm in an amount of about 0.1 weight percent to about 1.0 weight percent of the flake shape toner particles, silica having a particle size of from 12 nm to 30 nm in an amount of about 1 weight percent to 3.0 weight percent of the flake shape toner particles, silica having a particle size of from 30 nm to 50 nm in an amount of about 1 weight percent to 3.0 weight percent of the flake shape toner particles, and tabular shape metallic pigments, the flake shape toner particles having an average major axis length of from 6 μm to 20 μm, an average thickness of from 1 μm to 4 μm and an average circularity of from 0.5 to 0.9, and the tabular shape metallic pigments having an average major axis length of from 1 μm to 14 μm an average thickness of from 0.01 μm to 0.5 μm;

at least one transfer device for transferring the toner images to a recording medium; and a fuser station for fixing the toner image transferred to the recording medium by heating the recording medium, thereby forming a fused image on the recording medium, wherein the fuser station comprises a fuser member and a pressure member.

10. The image forming apparatus according to claim 9, wherein the tabular shape metallic pigments are selected from the group consisting of: silver, aluminum, brass, bronze, nickel and zinc.

11. The image forming apparatus according to claim 9, wherein the surface additive comprises a metal stearate is in an amount of 0.2 weight percent to about 1.0 weight percent of the flake shape toner particles.

12. The image forming apparatus according to claim 11, where the metal stearate is selected from the group consisting of: aluminum stearate, calcium stearate and zinc stearate.

13. The metallic toner according to claim 9, wherein the flake shape toner particles further comprise a wax.

14. The image forming apparatus according to claim 9, wherein the flake shape toner particles further comprise titanium dioxide in an amount of 0.5 weight percent to 2 weight percent of the flake shape toner particles.

15. The image forming apparatus according to claim 14, wherein the titanium dioxide has a particle size of from 15 nm to 40 nm.

16. A metallic toner comprising:

flake shape toner particles having a binder resin, a surface additive, tabular shape metallic pigments, silica having a particle size of from 7 nm to less than 12 nm in an amount of about 0.1 weight percent to about 1.0 weight percent of the flake shape toner particles, silica having a particle size of from 12 nm to less than 30 nm in an amount of about 0.1 weight percent to about 1.0 weight percent of the flake shape toner particles tabular shape metallic pigments, silica having a particle size of from 12 nm to 30 nm in an amount of about 1 weight percent to 3.0 weight percent of the flake shape toner particles, silica having a particle size of from 30 nm to 50 nm in an amount of about 1 weight percent to 3.0 weight percent of the flake shape toner particles the flake shape toner particles having an average major axis length of from 6 μm to 20 μm, an average thickness of from 1 μm to 4 μm and an average circularity of from 0.5 to 0.97, and the tabular shape metallic pigments having an average major axis length of from 1 μm to 14 μm an average thickness of from 0.01 μm to 0.5 μm.

17. The metallic toner according to claim 16, wherein the flake shape toner particles further comprise a wax.

18. The metallic toner according to claim 16, wherein the flake shape toner particles further comprise a charge control agent.

* * * * *